US012753572B2

(12) United States Patent
Bilodeau

(10) Patent No.: US 12,753,572 B2
(45) Date of Patent: Oct. 6, 2026

(54) DIFFERENTIAL DOZER BLADE LIFT AND ANGLE MECHANISM

(71) Applicant: Martin Nicolas Benoît Bilodeau, Sherbrooke (CA)

(72) Inventor: Martin Nicolas Benoît Bilodeau, Sherbrooke (CA)

( * ) Notice: Subject to any disclaimer, the term of this patent is extended or adjusted under 35 U.S.C. 154(b) by 437 days.

(21) Appl. No.: 18/415,755

(22) Filed: Jan. 18, 2024

(65) Prior Publication Data

US 2024/0247464 A1 Jul. 25, 2024

Related U.S. Application Data

(60) Provisional application No. 63/576,157, filed on Jan. 20, 2023.

(51) Int. Cl.

| | |
|---|---|
| ***E02F 3/76*** | (2006.01) |
| ***E02F 3/80*** | (2006.01) |
| ***E02F 3/84*** | (2006.01) |
| ***E02F 9/22*** | (2006.01) |

(52) U.S. Cl.

CPC ..... *E02F 3/7613* (2013.01); *E02F 3/7618* (2013.01); *E02F 3/7627* (2013.01); *E02F 3/7631* (2013.01); *E02F 3/80* (2013.01); *E02F 3/844* (2013.01); *E02F 9/2203* (2013.01); *E02F 9/2271* (2013.01)

(58) Field of Classification Search

CPC ..... E02F 3/7613; E02F 3/7618; E02F 3/7631; E02F 3/7627; E02F 3/844; E01H 5/062; E01H 5/063

See application file for complete search history.

(56) References Cited

U.S. PATENT DOCUMENTS

| | | | | |
|---|---|---|---|---|
| 1,066,811 A | | 7/1913 | Harrison | |
| 1,330,253 A | | 2/1920 | Fuller | |
| 1,576,865 A | | 3/1926 | Staley | |
| 1,788,698 A | * | 1/1931 | Wooldridge ..... | E02F 3/7613 37/235 |
| 1,997,001 A | | 4/1935 | Lamb | |

(Continued)

FOREIGN PATENT DOCUMENTS

WO 2010133931 11/2010

OTHER PUBLICATIONS

Written Opinion and International Search Report issued on Mar. 27, 2024 in corresponding International PCT application No. PCT/CA2024/050053.

*Primary Examiner* — Christopher J Sebesta
*Assistant Examiner* — Audrey L Lusk
(74) *Attorney, Agent, or Firm* — Benoit Yelle; Lavery, de Billy, L.L.P.

(57) ABSTRACT

There is disclosed an earth moving vehicle and a blade control assembly for an earth moving vehicle comprising a machine body, a push member comprising a first end pivotally mounted to the machine body for rotation about a lift axis and a blade pivotally attached to a second end of the push member for rotation about an angle axis. The assembly comprises a pair of linear actuators interconnected between the machine body and the blade. The blade is raised and lowered about the lift axis by respectively simultaneously retracting or extending both of said linear actuators and the blade is angled about the angle axis by extending or retracting a first of said linear actuators relative to a second of said linear actuators.

22 Claims, 6 Drawing Sheets

(56) References Cited

U.S. PATENT DOCUMENTS 2,059,431 A * 11/1936 Barrett ..... E02F 3/7613 144/34.1
2,108,466 A 2/1938 Allin et al.
2,119,373 A * 5/1938 Wooldridge ..... E02F 3/7613 172/823
2,173,158 A * 9/1939 Corbett ..... E02F 3/7613 172/823
2,730,823 A * 1/1956 Cassidy ..... E02F 3/7613 172/813
2,732,963 A * 1/1956 Grubich ..... E02F 3/3417 280/834
2,766,536 A * 10/1956 Perkins ..... E02F 3/844 405/174
2,777,222 A * 1/1957 Allin, Jr. ..... E02F 3/7613 172/823
2,817,168 A * 12/1957 Mullin ..... E02F 3/8152 172/826
2,942,363 A * 6/1960 Long ..... E02F 3/7618 172/825
3,018,573 A * 1/1962 Mcadams ..... E02F 3/7618 172/824
3,059,356 A 10/1962 Lorang
3,122,850 A * 3/1964 Rockwell ..... B62D 53/02 172/825
3,157,099 A * 11/1964 Ulrich ..... E02F 3/80 172/815
3,184,869 A 5/1965 Olsen
3,246,406 A * 4/1966 Ray, Jr. ..... E02F 3/7613 172/822
3,296,721 A * 1/1967 Coontz ..... E02F 3/7618 172/817
3,307,275 A * 3/1967 Simi ..... E02F 3/844 37/234
3,487,884 A * 1/1970 Volberding ..... E02F 3/7618 172/825
3,529,678 A * 9/1970 Teasdale ..... E02F 3/7613 172/739
3,631,931 A * 1/1972 Frisbee ..... E02F 3/7613 172/484
3,653,450 A * 4/1972 Rockwell ..... E02F 3/7618 172/826
3,674,096 A * 7/1972 Berg ..... E02F 3/80 37/236
3,705,631 A * 12/1972 Seaberg ..... E02F 3/844 91/518
3,822,751 A * 7/1974 Waterman ..... E02F 3/7631 172/825
3,823,783 A * 7/1974 Luedtke ..... E02F 3/7618 172/815
3,853,181 A * 12/1974 Yoshizaki ..... E02F 3/7627 172/820
3,913,684 A 10/1975 Casey et al.
4,006,782 A * 2/1977 Nishino ..... E02F 3/7618 172/815
4,061,194 A * 12/1977 McCanse ..... E02F 3/844 172/260.5
4,139,066 A 2/1979 Goodney et al.
4,201,268 A * 5/1980 Frisbee ..... E02F 3/7613 172/812
4,249,323 A * 2/1981 Mathis ..... E01H 5/06 37/232
4,270,617 A 6/1981 Cantarella
4,664,203 A * 5/1987 Williams ..... E02F 3/7618 172/826
4,828,044 A * 5/1989 Horsch ..... E02F 3/80 172/824
5,010,961 A * 4/1991 Frisbee ..... E02F 3/7613 172/831
5,447,204 A * 9/1995 Asal ..... E02F 3/7613 172/821
5,620,053 A 4/1997 Kamikawa et al.
5,634,523 A * 6/1997 Kobayashi ..... E02F 3/80 172/818
5,901,793 A * 5/1999 Frisbee ..... E02F 3/7618 172/816
6,907,941 B1 6/2005 Hoffart
6,955,229 B1 * 10/2005 Hoffart ..... E02F 3/844 172/795
D749,617 S 2/2016 Noack
2002/0139545 A1 * 10/2002 Haringer ..... E02F 3/7627 172/815
2003/0140529 A1 * 7/2003 Bloxdorf ..... E01H 5/066 37/266
2008/0210446 A1 * 9/2008 Cherney ..... E02F 3/7618 172/812
2013/0085645 A1 * 4/2013 Hayashi ..... E02F 3/845 701/50
2016/0108603 A1 * 4/2016 Hoyt ..... E02F 3/7613 172/663
2016/0186408 A1 6/2016 Hoyt et al.
2022/0090349 A1 3/2022 Wuisan et al.

* cited by examiner

DIFFERENTIAL DOZER BLADE LIFT AND ANGLE MECHANISM

CROSS REFERENCE TO RELATED APPLICATIONS

This application claims benefit of U.S. provisional application Ser. No. 63/576,157 filed Jan. 20, 2023 which is incorporated herein in its entirety by reference.

FIELD OF THE INVENTION

The present invention relates to a differential dozer blade lift and angle mechanism. In particular, the present invention relates to an arrangement for controlling both the lift and angle of bulldozer blades using a pair of actuators.

BACKGROUND OF THE INVENTION

Prior art power-angle blades for dozers use at least four linear actuators to both lift the blade and angle the blade to the direction of travel. Two of these are used to operate the blade lift mechanism and the other two to adjust the blade angle. This leads to a more complicated and heavier mechanism.

SUMMARY OF THE INVENTION

In order to address the above and other drawbacks there is provided an earth moving vehicle for moving earth along a surface. The moving vehicle comprises a machine body comprising a forward end, a source of motive force and at least one wheel for conveying the motive force to the surface and such that the machine body is moved in a direction faced by the forward end, a push member comprising a first end pivotally mounted to the machine body for rotation about a lift axis, an elongate blade positioned in front of the forward end and comprising a front face facing generally away from the forward end, a lower long edge arranged adjacent the surface and a rear face opposite the front face wherein the rear surface is pivotally attached to a second end of the push member for rotation about an angle axis, and a pair of linear actuators, each actuator independently controlled and comprising a first end pivotally attached to the machine body for rotation about a third axis and a second end attached to the rear face on respective side of the second end of the push member, wherein the lift axis and the third axis are arranged in parallel, wherein the lift axis and the angle axis are arranged at right angles, wherein the blade is raised and lowered about the lift axis by respectively simultaneously retracting or extending both of the linear actuators, wherein the blade is angled about the angle axis by extending or retracting a first of the linear actuators relative to a second of the linear actuators.

There is also provided an earth moving vehicle for moving earth. The earth moving vehicle comprises a machine body, a push member comprising a first end pivotally mounted to the machine body for rotation about a lift axis, an elongate blade positioned in front of the forward end and pivotally attached to a second end of the push member for rotation about an angle axis wherein the lift axis and the angle axis are arranged at right angles, a pair of hydraulic pistons, each piston comprising a first end pivotally attached to the machine body for rotation about a third axis and a second end attached to the blade on respective side of the second end of the push member, wherein the lift axis and the third axis are arranged in parallel, a source of hydraulic pressure, a pair of control valves, each of the valves controllably interconnecting the source of hydraulic pressure with a respective one of the hydraulic pistons, wherein operating both of the control valves such that both of the hydraulic pistons are one of simultaneously retracted or extended respectively raises or lowers the blade about the lift axis, and wherein operating at least one of the control valves such that a first of the hydraulic pistons is extended or retracted relative to a second of the hydraulic pistons angles the blade about the angle axis.

Additionally, there is provided a blade control assembly for an earth moving vehicle comprising a machine body, a push member comprising a first end pivotally mounted to the machine body for rotation about a lift axis and a blade pivotally attached to a second end of the push member for rotation about an angle axis. The assembly comprises a pair of linear actuators interconnected between the machine body and the blade, wherein the blade is raised and lowered about the lift axis by respectively simultaneously retracting or extending both of the linear actuators, wherein the blade is angled about the angle axis by extending or retracting a first of the linear actuators relative to a second of the linear actuators.

Furthermore, there is provided a blade control assembly for an earth moving vehicle comprising a machine body, a push member comprising a first end pivotally mounted to the machine body for rotation about a lift axis and a blade pivotally attached to a second end of the push member for rotation about an angle axis. The assembly consists essentially of a pair of linear actuators interconnected between the machine body and the blade, wherein the blade is raised and lowered about the lift axis and angled about the angle axis by the pair of linear actuators.

DETAILED DESCRIPTION OF THE ILLUSTRATIVE EMBODIMENTS

Figure 1:
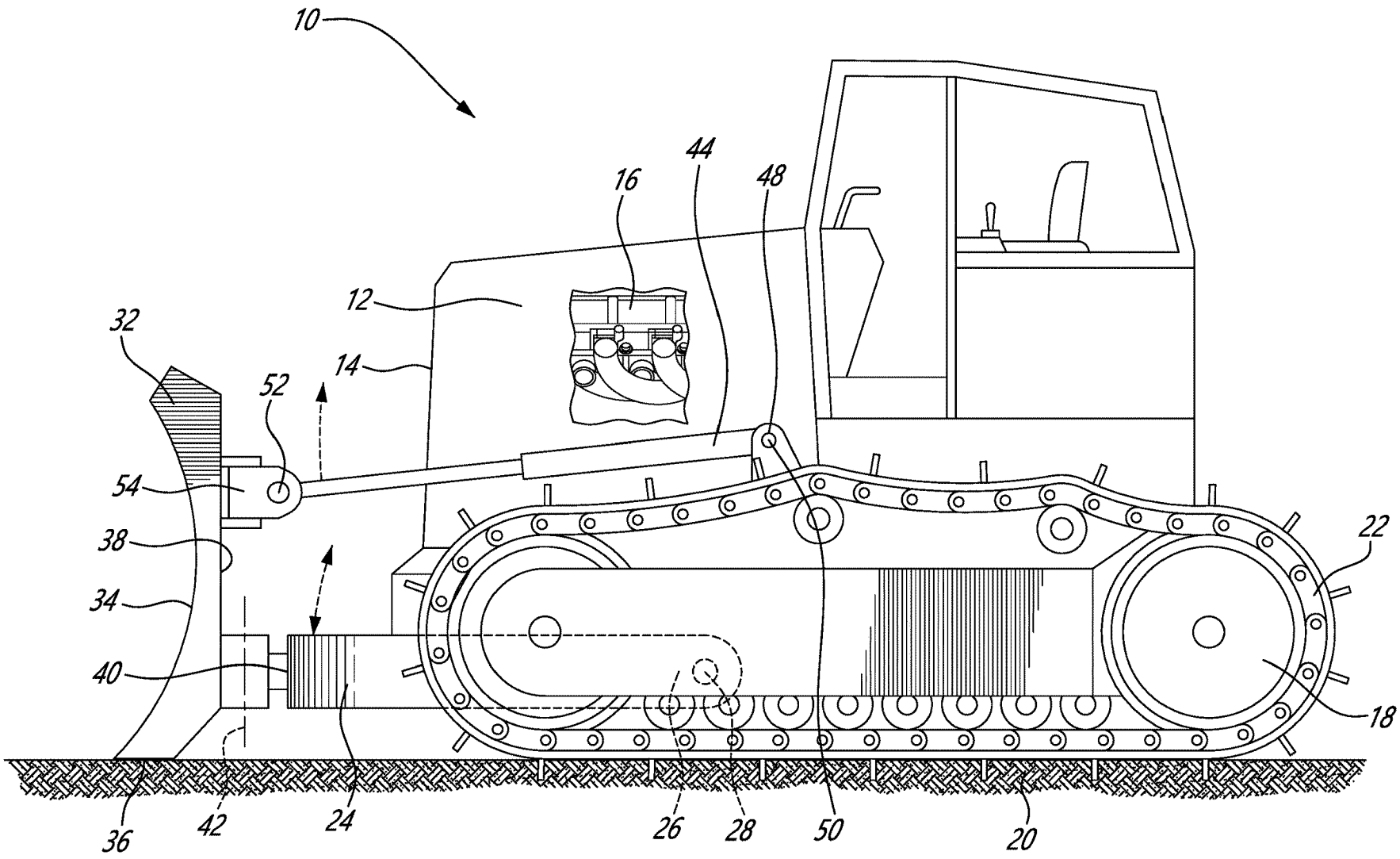
FIG. 1 provides a side plan view of an earth moving vehicle in accordance with an illustrative embodiment of the present invention.

Referring now to FIG. 1, a vehicle for moving earth, such as a bulldozer, and generally referred to using the reference numeral 10, will now be described. The vehicle 10 comprises a vehicle body 12 comprising a forward end 14 and a source of motive force 16 such as a diesel engine or the like. The source of motive force is interconnected with at least one wheel, or cog, 18 which conveys the motive force to the ground 20, illustratively via a track or the like 22 and in order to move the vehicle in forward or rearward direction.

Figure 2:
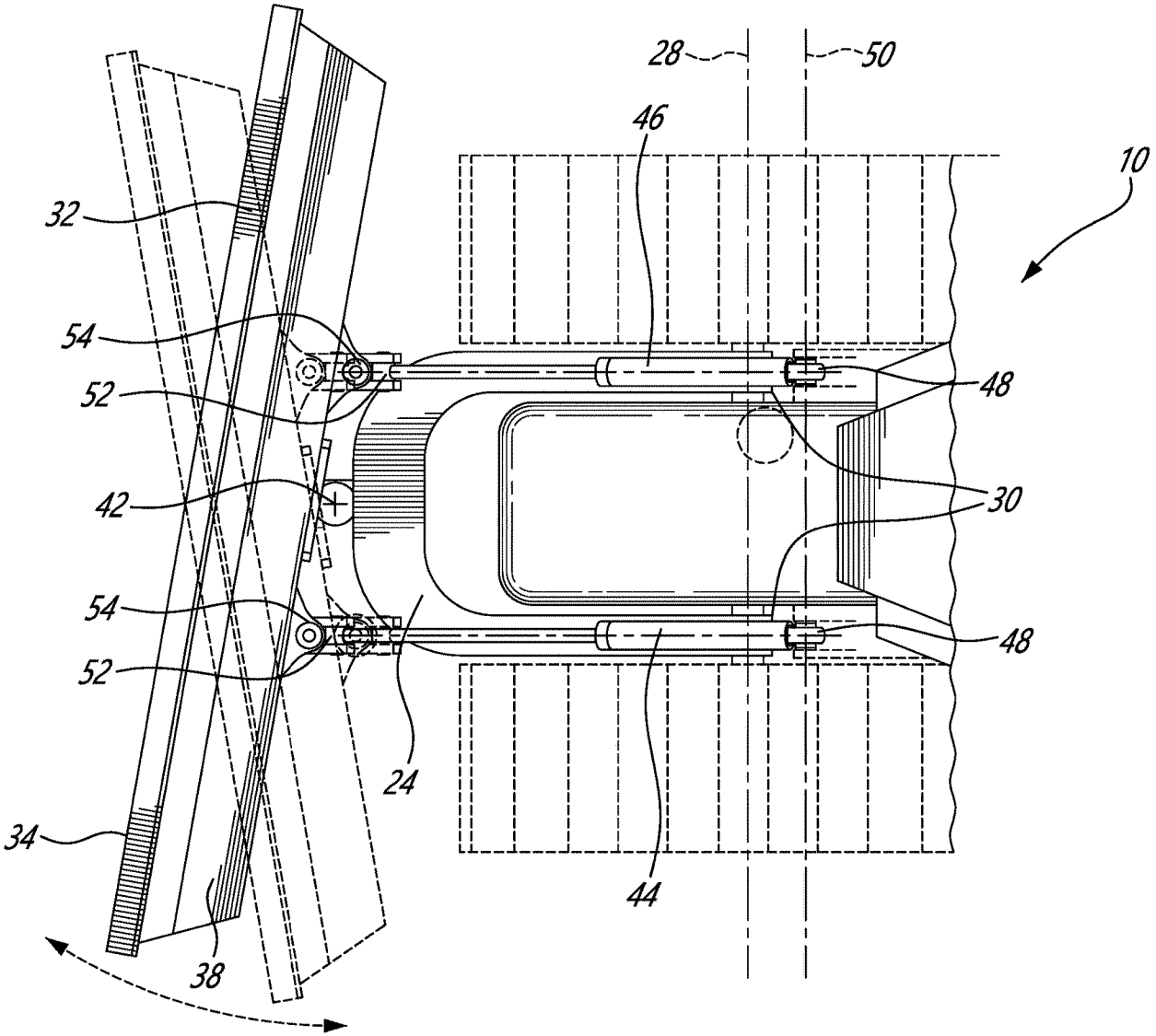
FIG. 2 provides a top plan view of the earth moving vehicle according to FIG. 1 and in accordance with an illustrative embodiment of the present invention.

Referring now to FIG. 2 in addition to FIG. 1, a push member 24, such as a C-frame or the like, is mounted to the vehicle body 12 and such that a first end 26 of push member 24 is rotatable about a lift axis 28 which is transverse to the vehicle body 12 and the general forward direction of travel of the vehicle 10. In this regard, the push member 24 may be C-shaped such that the forward end 14 of the vehicle body 12 is received within the mouth of the "C" and the outer ends 30 of the "C" are each configured to rotate about the lift axis 28.

Still referring FIGS. 1 and 2, an elongate blade 32 is positioned in front of the forward end 14 of the vehicle body 12. The blade 32 comprises a front face 34 facing generally away from the forward end 14 of the vehicle body 12 and in the direction of forward travel of the vehicle 10. A lower long edge 36 of the blade 32 is arranged adjacent the surface of the ground 20. The rear face 38 of the blade 32 is pivotally attached to a second end 40 of the push member 24 and for rotation about an angle axis 42, generally normal to the surface of the ground 20 and at right angles to the lift axis 28.

Still referring FIGS. 1 and 2, a blade control assembly comprising a pair of independently controllable actuators 44, 46, illustratively hydraulic pistons, which are fed by a hydraulic system (not shown) powered by the source of motive force 16, are provided. The first end 48 of each actuator 44, 46 is mounted to the vehicle body 12 for rotation about a common third axis 50. The third axis 50 is arranged in parallel to and generally above the lift axis 28. The second end 52 of each of the actuators 44, 46 mounted to the rear face 38 on a respective side of the second end 40 of the push member 24, illustratively using a universal-type mount 54. A person of ordinary skill in the art will understand that a small amount of angular movement may be provided for at the point of attachment of the first end 48 to the third axis 50, for example through provision of a fisheye joint or the like at the first end 48 of each of the actuators 44, 46, and in order to accommodate the small changes in lateral spacing between the second ends 52 of each of the actuators 44, 46 when the blade 32 is angled.

Figure 3:
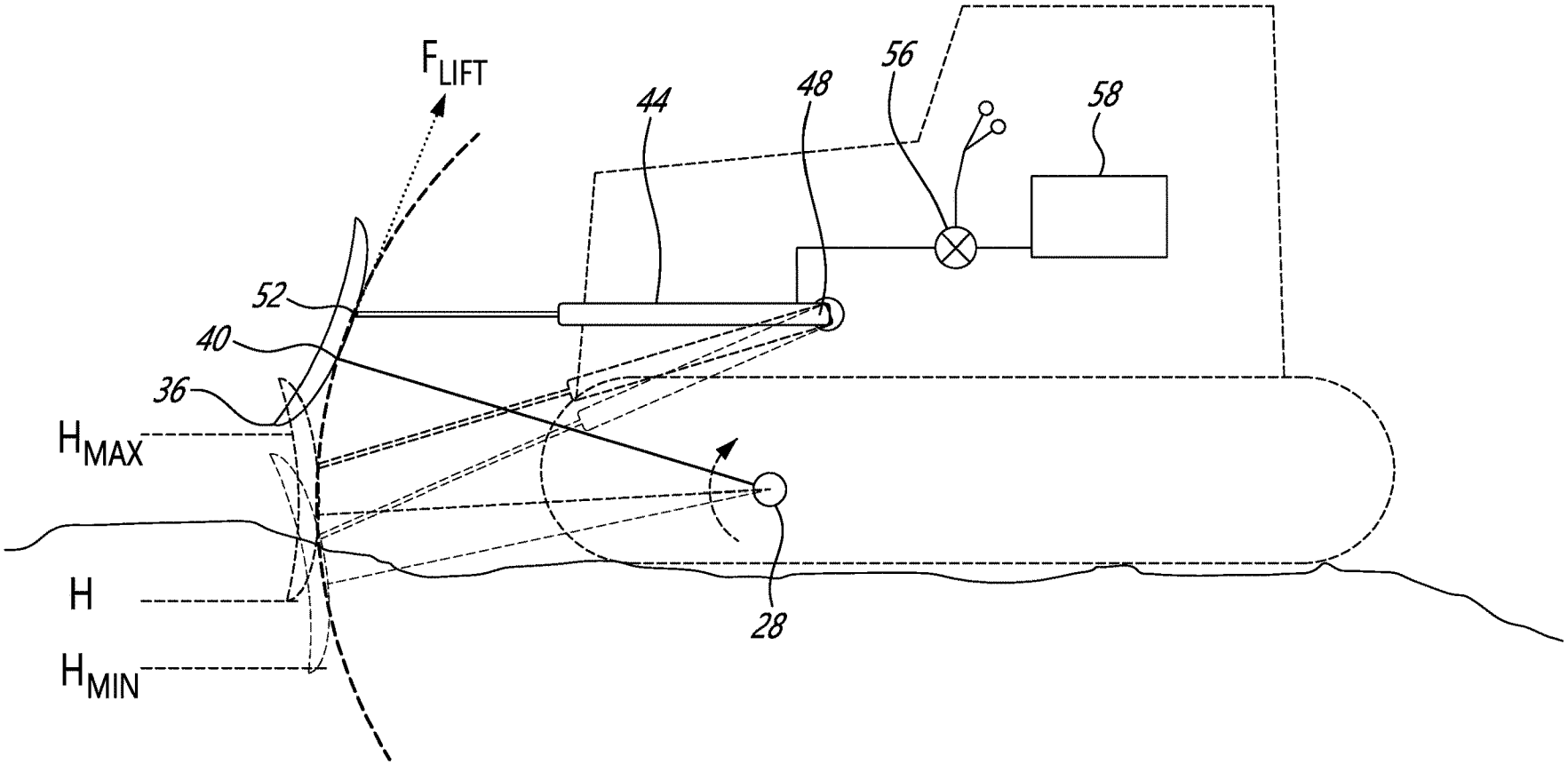
FIG. 3 provides a schematic diagram of a differential dozer blade mechanism when lifting and in accordance with an illustrative embodiment of the present invention.

Referring now to FIG. 3 in addition to FIGS. 1 and 2, by illustratively simultaneously retracting both of the actuators 44, 46, for example by actuating a control valve 56 attached to a source of hydraulic pressure 58 and such that the second end 52 of each actuator 44, 46 is brought the same distance closer to the first end 48, a lifting force $F_{LIFT}$ can be brought to bear on the outer ends 30 of the push member 24 and such that the push member 24 is rotated in a lifting direction about the lift axis 28 and, as a result, the lower edge 36 of the blade 32 raised to a selected height H up to a maximum height $H_{MAX}$. Similarly, by simultaneously extending both of the actuators 44, 46 and such that the second end 52 of each actuator 44, 46 is moved away from the first end 48 the same distance, the lifting force $F_{LIFT}$ is reversed and such that the push member 24 is rotated in a lowering direction about the lift axis 28 and, as a result, the blade 32 lowered to a selected height H down to a minimum height $H_{MIN}$.

Figure 4:
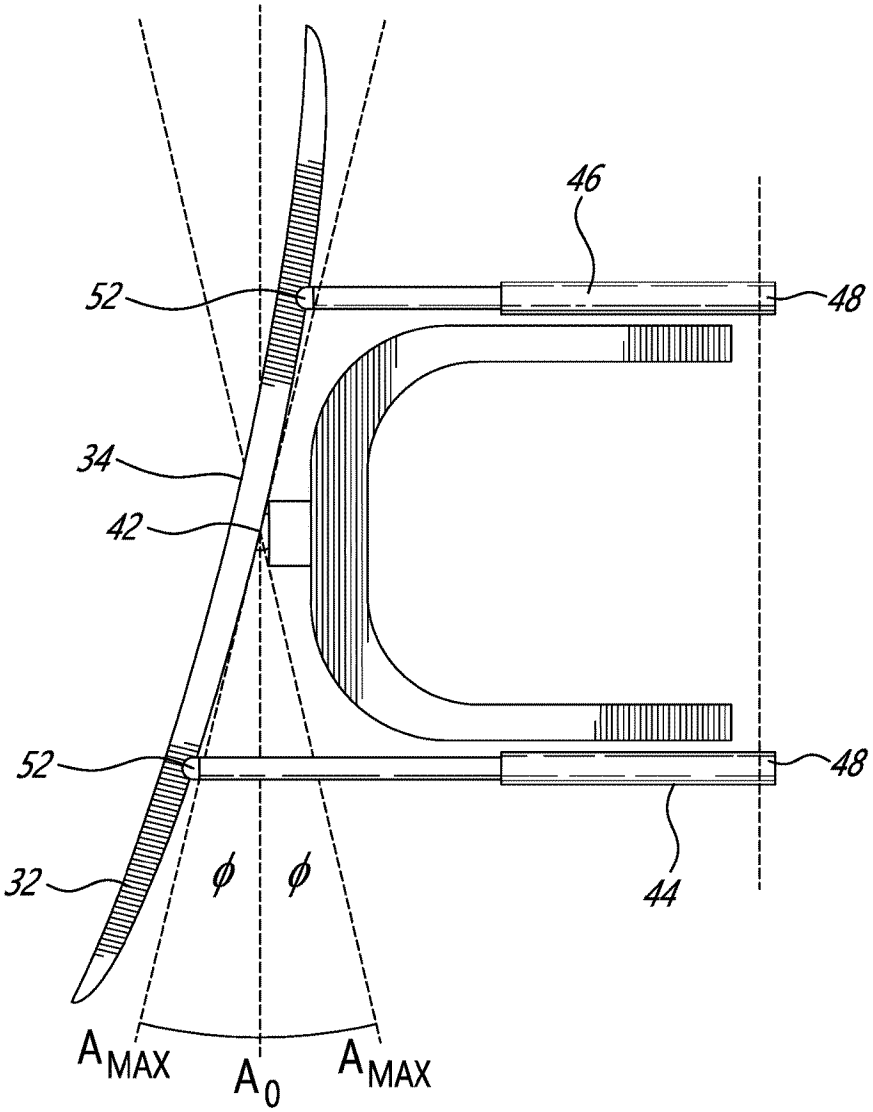
FIG. 4 provides a schematic diagram of a differential dozer blade mechanism when angling and in accordance with an illustrative embodiment of the present invention.

Referring to FIG. 4 in addition to FIGS. 1 and 2, by retracting or extending a first of the actuators 44 relative to a second of the actuators 46 and such that the distance between the first end 48 and second end 52 of the first actuator 44 is different from the distance between the first end 48 and second end 52 of the second actuator 46, the blade 32 can be rotated about the angle axis 42 and such that the front face 34 of the blade 32 is at an angle to forward direction of the vehicle 10. As a person of ordinary skill in the art will now understand, by adjusting the actuators 44, 46 a given angle Φ from the normal centred position $A_0$ at right angles to the forward direction of the vehicle 10 can be selected between a maximum angles $A_{MAX}$.

Referring to FIG. 3 in addition to FIGS. 1, 2, and 4, a person of ordinary skill in the art will now understand that a lifted and angled blade 32 can be arrived at. For example, the blade 32 may be lifted of the ground to a given height H and then once in this lifted position one or other of the actuators 44, 46 extended or retracted and such that the lifted blade is rotated about the angle axis 42 and such that the lifted bladed is angled relative to the direction of forward travel of the vehicle 10. Similarly, the blade 32 may be angled to a given angle A and then once in this angled position both the actuators 44, 46 simultaneously retracted and such that the angled blade 32 is lifted above the ground 20.

Figure 5:
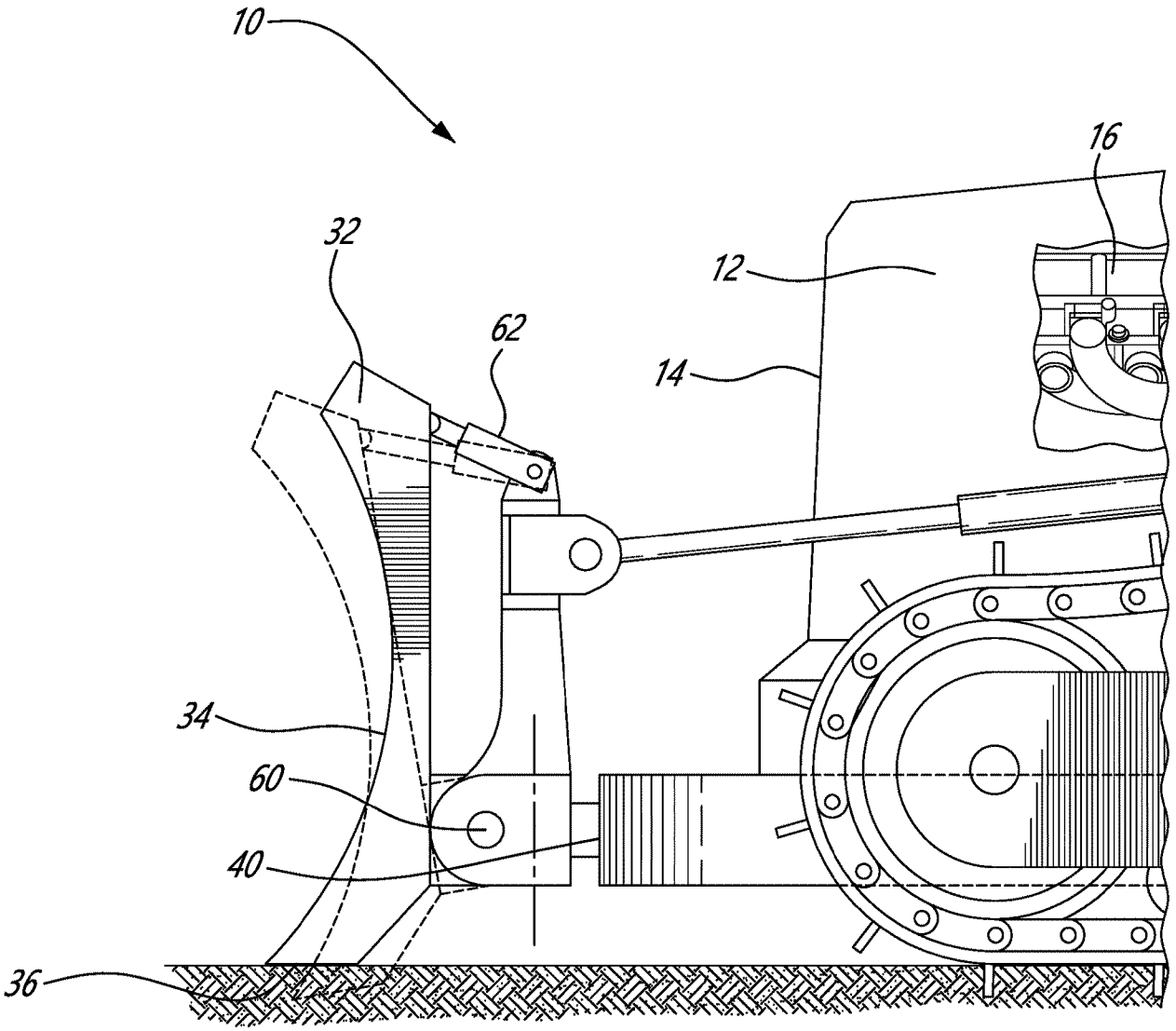
FIG. 5 provides a partial side plan view of an earth moving vehicle in accordance with a first alternative illustrative embodiment of the present invention.

Referring now to FIG. 5, in a first alternative embodiment the rear surface 38 of the blade 32 is mounted to the second end 40 of the push member 24 such that the blade 32 may pitch about a pitch axis 60 arranged in parallel to the axis of the elongate blade 32. A third linear actuator, such as a hydraulic piston 62, is provided. Extending the hydraulic piston 62 allows the blade 32 to be pitched about the pitch axis 60 and such that the lower edge 36 of the blade 32 may be lowered or raised.

Figure 6A:
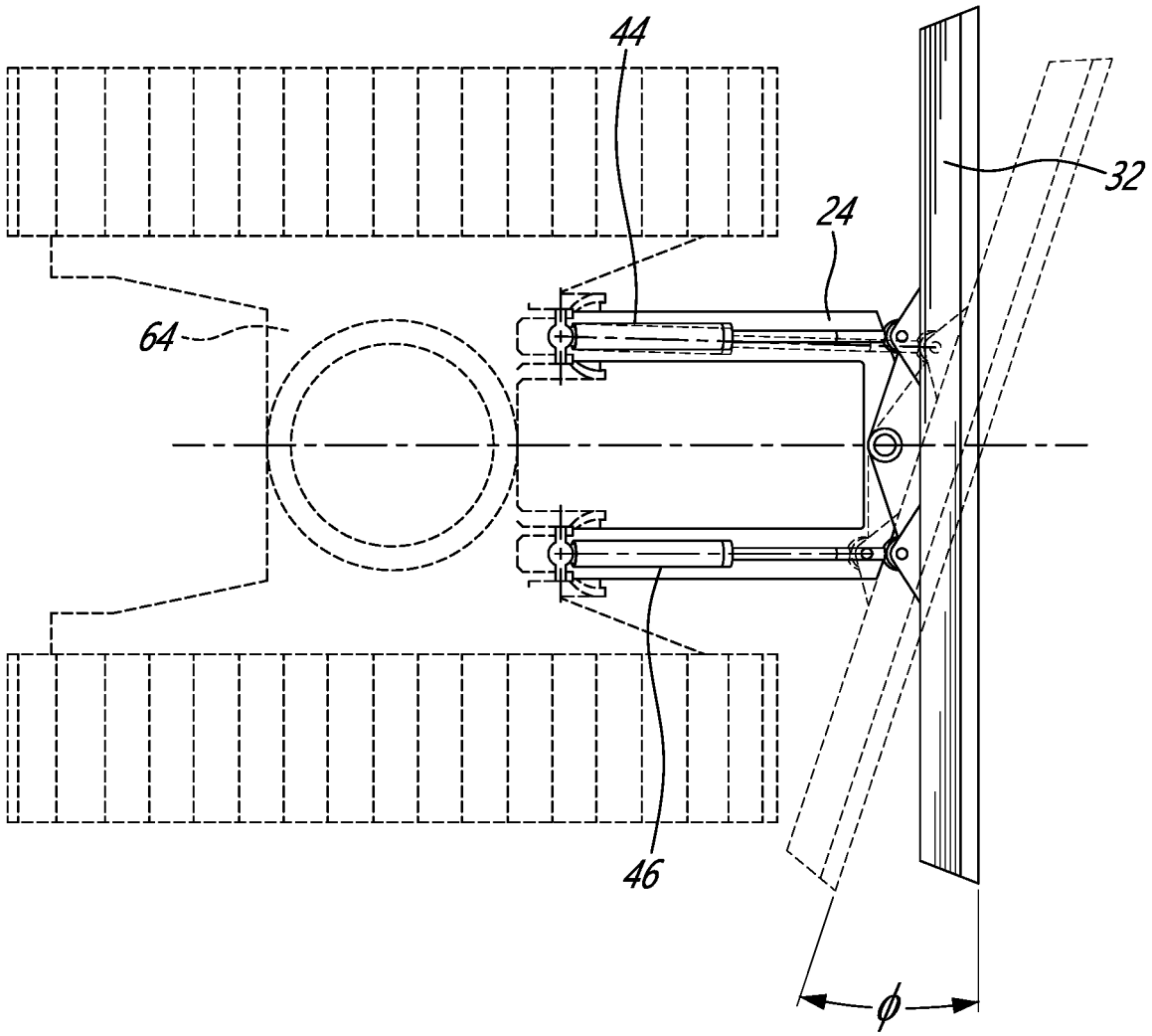
FIGS. 6A and 6B provide respectively a partial top plan view and a partial side plan view of a crawler excavator in accordance with a second alternative illustrative embodiment of the present invention.
Figure 6B:
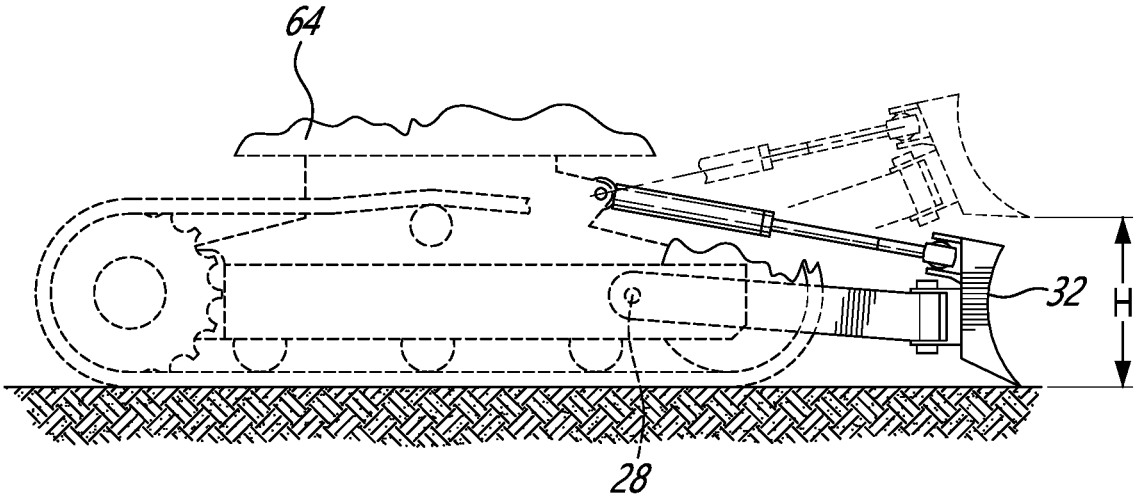

Referring now to FIGS. 6A and 6B, in a second alternative illustrative embodiment, the blade 32 is attached to a crawler excavator body 64 via a push member 24 and a pair of linear actuators 44, 46. As discussed above, operation of the linear actuators 44, 46 in the same direction together allows the blade to be lifted about the lift axis 28 and such that the blade may be raised to a given height H. Additionally, operation of one of the first linear actuator 44 or the second linear actuator 46 such that they are retracted or extended relative to one another allows the blade 32 to be angled to a given angle Φ from the normal centred position.

Although the present invention has been described hereinabove by way of specific embodiments thereof, it can be modified, without departing from the spirit and nature of the subject invention as defined in the appended claims.

The invention claimed is:

1. An earth moving vehicle for moving earth along a surface, comprising:

a machine body comprising a forward end, a source of motive force and at least one wheel for conveying said motive force to the surface and such that said machine body is moved in a direction faced by said forward end;

a push member comprising a first end pivotally mounted to said machine body for rotation about a lift axis;

an elongate blade positioned in front of said forward end and comprising a front face facing generally away from said forward end, a lower long edge arranged adjacent the surface and a rear face opposite said front face wherein said rear surface is pivotally attached to a second end of said push member for rotation about an angle axis; and a pair of linear actuators, each actuator independently controlled and comprising a first end pivotally attached to said machine body for rotation about a third axis and a second end attached to said rear face on respective side of said second end of said push member;

wherein said lift axis and said third axis are arranged in parallel;

wherein said lift axis and said angle axis are arranged at right angles;

wherein said blade is raised and lowered about said lift axis by respectively simultaneously retracting or extending both of said linear actuators;

wherein said blade is angled about said angle axis by extending or retracting a first of said linear actuators relative to a second of said linear actuators.

2. The earth moving vehicle of claim 1, wherein each of said linear actuators comprises a hydraulic piston.

3. The earth moving vehicle of claim 1, wherein said third axis is positioned above said lift axis.

4. The earth moving vehicle of claim 1, wherein said first end of said push member comprises a pair of elongate legs and further wherein an end of each of said legs is pivotally mounted to said machine body for rotation about said lift axis.

5. The earth moving vehicle of claim 1, wherein said push member comprises a C-frame.

6. The earth moving vehicle of claim 1, wherein said front face is concave.

7. The earth moving vehicle of claim 1, further comprising a swivel for pivotally attaching said rear surface to said second end of said push member.

8. The earth moving vehicle of claim 1, wherein each of said actuators comprises a fisheye joint for pivotally attaching said first end to said machine body.

9. The earth moving vehicle of claim 1, wherein said rear surface is pivotally attached to a second end of said push member for rotation about a pitch axis, said pitch axis in parallel to an axis of said elongate blade and further comprising a third linear actuator comprising a first end of said third linear actuator attached to said second end of said push member and a second end of said third linear actuator attached to said rear face and such that actuation of said third linear actuator rotates said blade about said pitch axis.

10. An earth moving vehicle for moving earth, comprising:

a machine body;

a push member comprising a first end pivotally mounted to said machine body for rotation about a lift axis;

an elongate blade positioned in front of said forward end and pivotally attached to a second end of said push member for rotation about an angle axis wherein said lift axis and said angle axis are arranged at right angles;

a pair of hydraulic pistons, each piston comprising a first end pivotally attached to said machine body for rotation about a third axis and a second end attached to said blade on respective side of said second end of said push member, wherein said lift axis and said third axis are arranged in parallel;

a source of hydraulic pressure;

a pair of control valves, each of said valves controllably interconnecting said source of hydraulic pressure with a respective one of said hydraulic pistons;

wherein operating both of said control valves such that both of said hydraulic pistons are one of simultaneously retracted or extended respectively raises or lowers said blade about said lift axis; and wherein operating at least one of said control valves such that a first of said hydraulic pistons is extended or retracted relative to a second of said hydraulic pistons angles said blade about said angle axis.

11. The earth moving vehicle of claim 10, wherein each of said linear actuators comprises a hydraulic piston.

12. The earth moving vehicle of claim 10, wherein said third axis is positioned above said lift axis.

13. The earth moving vehicle of claim 10, wherein said first end of said push member comprises a pair of elongate legs and further wherein an end of each of said legs is pivotally mounted to said machine body for rotation about said lift axis.

14. The earth moving vehicle of claim 13, wherein said push member comprises a C-frame.

15. The earth moving vehicle of claim 10, wherein said front face is concave.

16. The earth moving vehicle of claim 10, further comprising a swivel for pivotally attaching said rear surface to said second end of said push member.

17. The earth moving vehicle of claim 10, wherein each of said hydraulic pistons comprises a fisheye joint for pivotally attaching said first end to said machine body.

18. The earth moving vehicle of claim 10, wherein said rear surface is pivotally attached to a second end of said push member for rotation about a pitch axis, said pitch axis in parallel to an axis of said elongate blade and further comprising a third hydraulic piston and a third control valve interconnecting said source of hydraulic pressure with said third hydraulic piston, a first end of said third hydraulic piston attached to said second end of said push member and a second end of said third hydraulic piston attached to said rear face, wherein operating said third hydraulic position such that said third hydraulic piston is extended or retracted rotates said blade about said pitch axis.

19. A blade control assembly for an earth moving vehicle comprising a machine body, a push member comprising a first end pivotally mounted to the machine body for rotation about a lift axis and a blade pivotally attached to a second end of the push member for rotation about an angle axis, the assembly comprising:

a pair of linear actuators interconnected between the machine body and the blade;

wherein the blade is raised and lowered about the lift axis by respectively simultaneously retracting or extending both of said linear actuators;

wherein the blade is angled about the angle axis by extending or retracting a first of said linear actuators relative to a second of said linear actuators.

20. The blade control assembly of claim 19, wherein the earth moving vehicle comprises a source of hydraulic pressure, wherein each of said linear actuators comprises a hydraulic piston and further wherein the assembly comprises a pair of control valves, each of said valves controllably interconnecting the source of hydraulic pressure with a respective one of said hydraulic pistons.

21. The blade control assembly of claim 19, wherein the blade is angled about the angle axis by extending a first of said linear actuators while retracting a second of said linear actuators.

22. A blade control assembly for an earth moving vehicle comprising a machine body, a push member comprising a first end pivotally mounted to the machine body for rotation about a lift axis and a blade pivotally attached to a second end of the push member for rotation about an angle axis, the assembly consisting essentially of:

a pair of linear actuators each interconnected between the machine body and the blade;

wherein the blade is raised and lowered about the lift axis and angled about the angle axis by said pair of linear actuators.

* * * * *